US007428758B2

(12) United States Patent
Park

(10) Patent No.: US 7,428,758 B2
(45) Date of Patent: Sep. 30, 2008

(54) COIN OPERATING BIDET RESPONSE TO USER'S SELECTION

(75) Inventor: Hyug Park, N. 1101 Maryland Ave. #N, Glendale, CA (US) 91207

(73) Assignee: Hyug Park, Glendale, CA (US)

( * ) Notice: Subject to any disclaimer, the term of this patent is extended or adjusted under 35 U.S.C. 154(b) by 307 days.

(21) Appl. No.: 11/204,843

(22) Filed: Aug. 17, 2005

(65) Prior Publication Data

US 2007/0094782 A1 May 3, 2007

(51) Int. Cl.
*E03D 9/08* (2006.01)

(52) U.S. Cl. ..... 4/420.2; 4/420.4

(58) Field of Classification Search ..... 4/420.2, 4/420.4, 447, 448
See application file for complete search history.

(56) References Cited

U.S. PATENT DOCUMENTS 4,028,745 A * 6/1977 Caniglia ..... 4/420.2
4,616,368 A * 10/1986 Nagai et al. ..... 4/420.2
4,628,548 A * 12/1986 Kurosawa et al. ..... 4/420.4
5,647,074 A * 7/1997 White et al. ..... 4/664
5,857,228 A * 1/1999 Waltenberger et al. ..... 4/662

* cited by examiner

*Primary Examiner*—Robert M. Fetsuga

(57) ABSTRACT

A user controlling coin operating bidet assembly is comprised of a coin handling system with a coin collector box and an electrically operating bidet. The coin handling system contains optical coin validator, solenoid valves, coin flaps, optical coin counter, electronic timer, and microprocessor controlling those parts according to the signals triggered by the coins inserted. The electronic timer receives signal from the microprocessor and supplies power to another solenoid valve and a warm air blower connected to the bidet. A switch for selecting water and air is attached on the control panel of the bidet. 25 cents coin allows 30 seconds operation. Additional 25 cents inserted within 30 seconds extends the operation time for another 30 seconds. Emergency "HOLD" switch placed on the control panel holds the power to the bidet and stops the electric timer. Pressing "RESET" switch on the control board returns the bidet in a continuing mode.

1 Claim, 5 Drawing Sheets

COIN OPERATING BIDET RESPONSE TO USER'S SELECTION

FIELD OF THE INVENTION

Current application related with a bidet, especially, a bidet operated by coin and the method of assembling the coin handling system and the bidet to respond to user's choice.

BACKGROUND OF THE INVENTION

Bidet is more popular in Europe and Japan rather than in the United States because every house in the United States has showering system built therein. However, many immigrants to the United States from those countries brings bidet and custom of using it with them and spreads it throughout their communities because it is more convenient than taking a shower. Conventional bidet is produced for private use in a house. In spite of the huge numbers of public toilets on the street, there is no public bidet even in the Hotels. In these days, more people prefers bidet if they try it once because it is more clean and make them feel pleasant. Especially, ladies favor bidet because it is known to be good for their sanitary hygiene. Many ladies wait for public rest rooms equipped with bidets. For many paid public restrooms, it is useless when more than one-person get in the restroom with one token. Attaching coin collector to each toilet commode has no meaning at all. But, for bidet, it is very effective to control the use of it.

It is the purpose of the current application to provide a bidet system, which is installable in public restrooms and makes money for maintaining the bidet system. Another purpose of the current application is to improve the function of bidet responding to user's selection.

DESCRIPTION OF THE PRIOR ART

U.S. Pat. No. 3,934,694 to Pedersen illustrates a coin-operated apparatus for dispensing a predetermined volume of a fluid to be purchased by insertion of a coin into a slot. U.S. Pat. No. 4,381,430 to Smock, et al. illustrates a coin receiver of a timing mechanism, an actuator rotates a ratchet, which in turn rotates a cam. U.S. Pat. No. 6,708,811 to Roscoe illustrates a coin handling assembly includes a coin vault loaded completely within an appliance cabinet. U.S. Pat. No. 4,237,560 to Riegelman disclosed a bidet seat housing in which are front and rear water jet nozzles and director members through which to pass water one or the other of the nozzles via a solenoid-operated diverter valve. U.S. Pat. No. 4,807,311 to Ingels illustrates a bidet attachment for conventional commodes, which have a bowl. The attachment has a swing arm with a spray head that can be moved toward and away from the center of the bowl. U.S. Pat. No. 4,951,702 to Brotcke illustrates a non-rise bidet valve comprising a housing having a fluid inlet and first and second discharge openings. U.S. Pat. No. 4,967,423 to Aoyama illustrates a bidet where attachment is provided for the underside of a toilet seat with selectively actuated outlets at the front and rear side thereof. U.S. Pat. No. 5,063,619 to Ross, et al. illustrates a vacuum breaker assembly for a bidet including a vacuum breaker body defining a fluid passageway there through and a vacuum breaker opening communicating with the fluid passageway. U.S. Pat. No. 5,991,937 to Safara illustrates a bidet device includes a hand held spray member. U.S. Pat. No. 6,000,070 to Bonin illustrates a toilet provides a traditional water filled bowl with flushing action as well as a bidet in one unit. U.S. Pat. No. 6,327,718 to Ono, et al. illustrates an apparatus for washing human privates including a water heater and. an air mixing device.

Various kind of coin validating systems are disclosed in U.S. Pat. No. 4,601,380 to Dean, et al., U.S. Pat. No. 4,742,903 to Trummer, U.S. Pat. No. 4,754,862 to Rawicz-szczerbo, et al., U.S. Pat. No. 4,989, U.S. Pat. No. 714 5,048,663, U.S. Pat. No. 5,080,216 to Abe, U.S. Pat. No. 5,002,174 to Yoshihara, U.S. Pat. No. 5,056,644 to Parker, U.S. Pat. No. 5,158,166 to Barson, U.S. Pat. No. 5,263,566 to Nara, et al., U.S. Pat. No. 6,398,001 to Hutchinson, et al.

Some of them use optical sensor and some of them use disturbance of magnetic field according to movement of coin.

U.S. Pat. No. 3,978,962 to Gregory, U.S. Pat. No. 3,998,309 to Mandas, et al., U.S. Pat. No. 4,106,610 to Heiman, U.S. Pat. No. 4,353,452 to Shah, et al., U.S. Pat. No. 4,413,718, U.S. Pat. No. 4,546,868 to Gregory, Jr., U.S. Pat. No. 4,558,71, U.S. Pat. No. 4,625,851 to Johnson, et al., U.S. Pat. No. 4,650,057 to Koester, U.S. Pat. No. 4,696,385 to Davies, U.S. Pat. No. 4,971,188 to Deters, U.S. Pat. No. 5,083,652 to Kobayashi, et al., U.S. Pat. No. 5,131,518 to Shimizu, U.S. Pat. No. 5,145,046 to Satoh, U.S. Pat. No. 5,154,272 to Nishiumi, et al., U.S. Pat. No. 5,496,212 to Meyer-Weingartner, et al. illustrates coin sorting systems for coin operating machines. Irrespective of what kind of coin feeder is applied, all the sorting systems are equipped with returning slot for invalid coins.

None of the prior art illustrates how to assemble the coin sorting system and bidets to realize coin operate according to user's selection.

SUMMARY OF THE INVENTION

Conventional bidet is produced for private use in a house. In spite of the huge numbers of public toilets on the street, there is no public bidet even in the Hotels. In these days, more people prefer bidet if they try it once because it is more clean and make the them feel pleasant. Especially, ladies favor bidet because it is known to be good for their generic hygiene. Many ladies wait for public restrooms equipped with bidets. For many paid public restrooms, it is not economical to install coin pay system when more than one person get in the restroom with one token. Attaching coin collector to each toilet commode has no meaning at all because people can use it without flushing water. But, for bidet, it is very effective because user must pay for the water to wash their body. It is the purpose of the current application to provide a bidet system, which is installable in public restrooms and makes money for maintaining the bidet system. A coin-operating bidet for the purpose of the current application is comprised of a coin handling system with a coin collector box and an electrically operating bidet. The coin handling system contains a coin validator, solenoid valves, coin flaps, coin counter, electronic timer, and micro-processor controlling those parts according to the signals triggered by the coins inserted. The electronic timer receives signal from the micro-processor and supplies power to another solenoid valve and a warm air blower connected to the bidet. A switch for selecting water and air is placed on the control panel of the bidet. 25 cents coin allows 30 seconds operation. Additional 25 cents inserted within 30 seconds extends the operation time for another 30 seconds. Emergency "HOLD" switch placed on the control panel holds the power to the bidet and stops the electric timer. Pressing "RESET" switch on the control board returns the bidet in a continuing mode.

DETAILED DESCRIPTION OF THE PREFERRED EMBODIMENT

Figure 1:
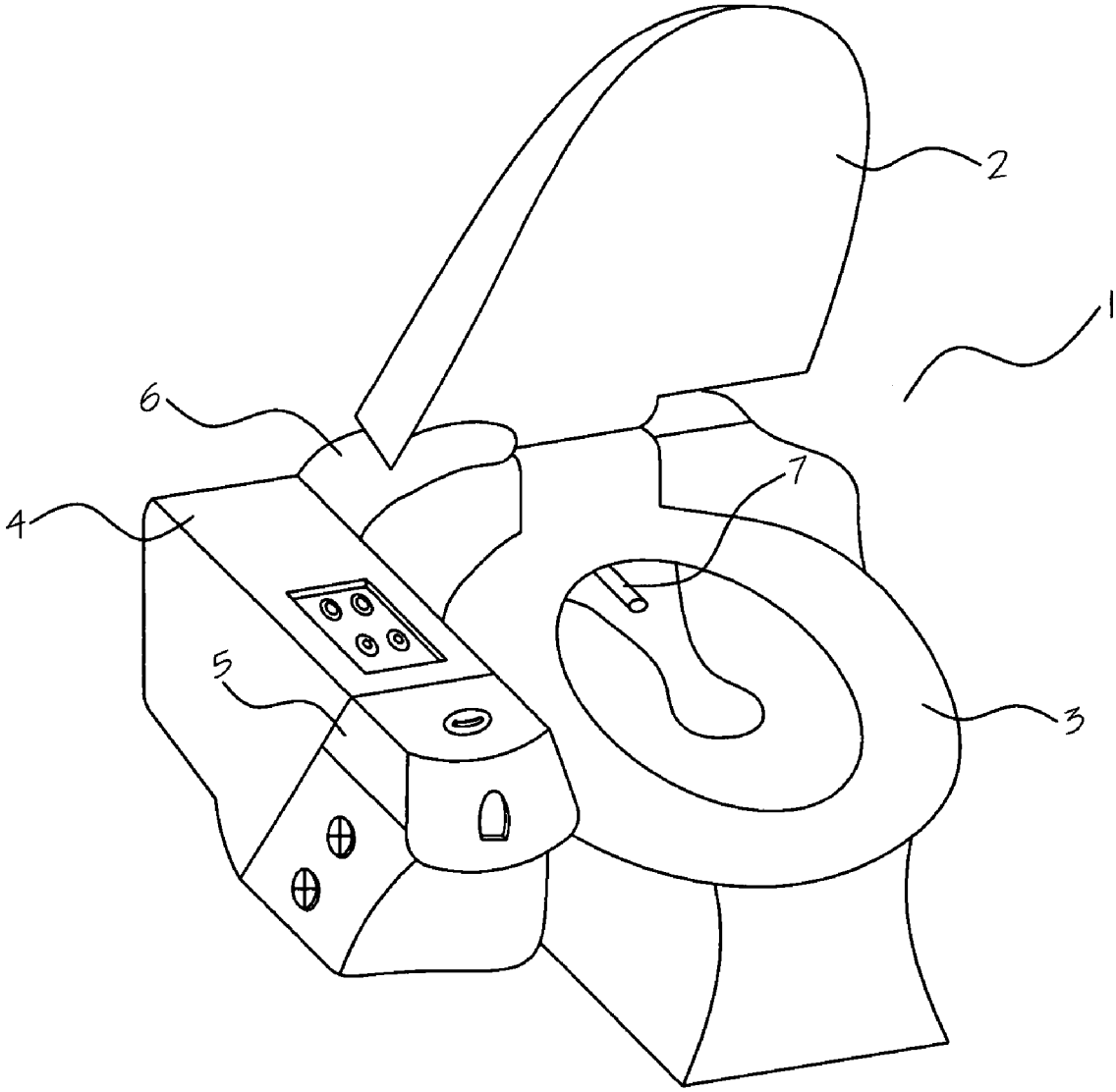
FIG. 1 is a perspective view of a coin-operating bidet of the current application.

FIG. 1 is a perspective view of a coin-operating bidet (1) of the current application. The bidet (1) according to current application is a mountable bidet to any of existing commode seat in public rest rooms. Therefore, a seat lid (2) and a seat cover (3) are assembled to a control box (4) and a coin handling system (5) via line covers (6), which covers electric-wires connected to solenoid valves (not show in the figures) that control the stream of water and air through a nozzle (7).

Figure 2:
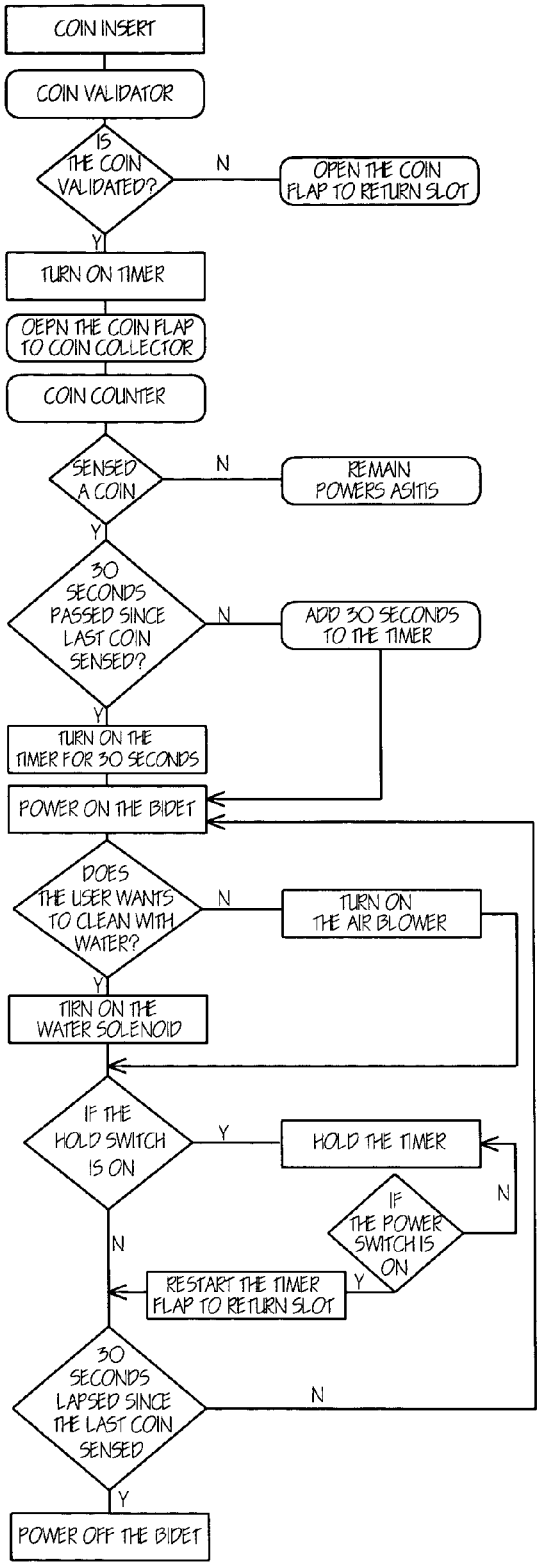
FIG. 2 is a schematic logic diagram of the coin bidet of the current application.
Figure 3:
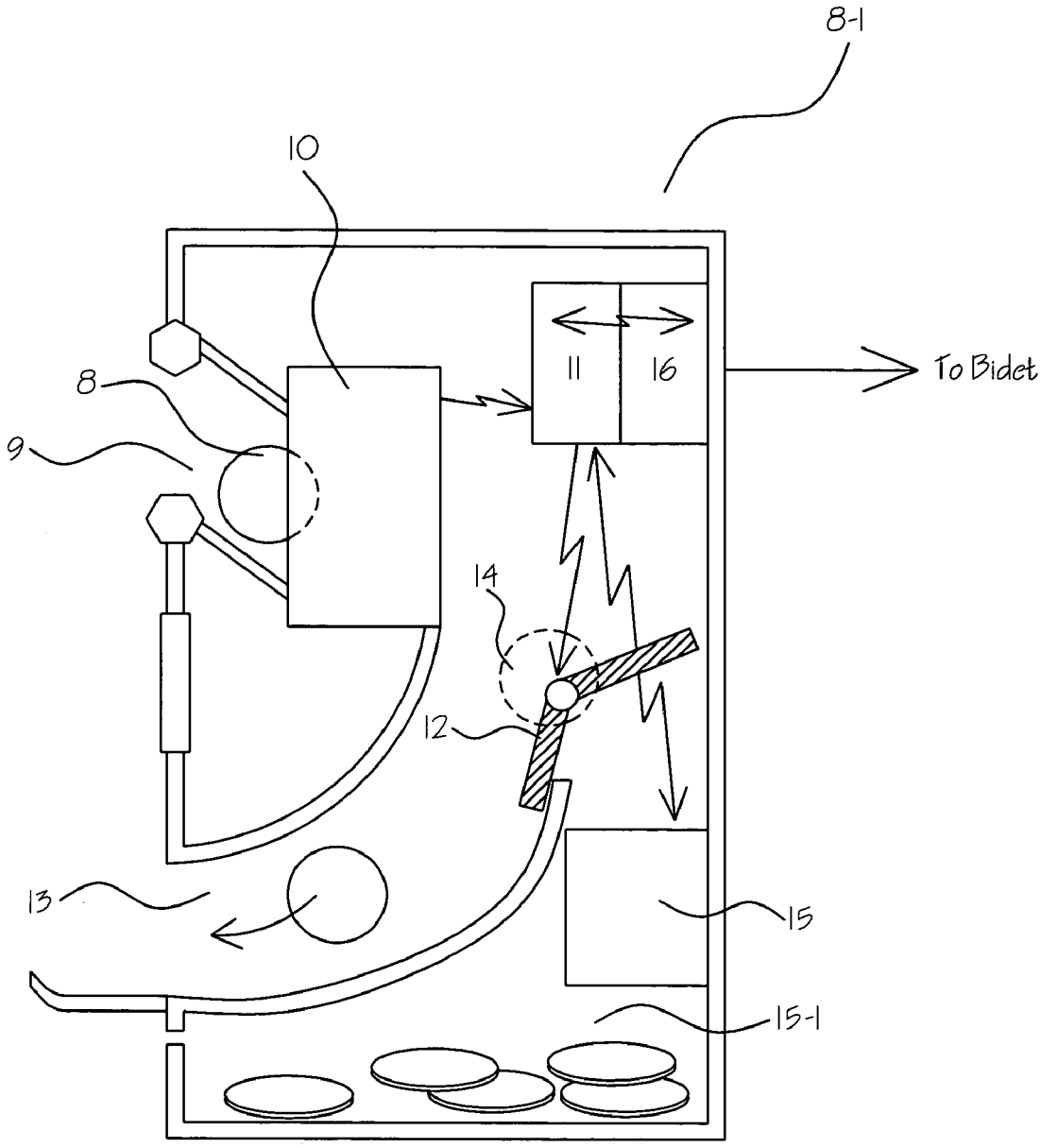
FIG. 3 is a schematic cross sectional view showing the coin handling assembly of the current application when the coin flap is open to return slot.
Figure 4:
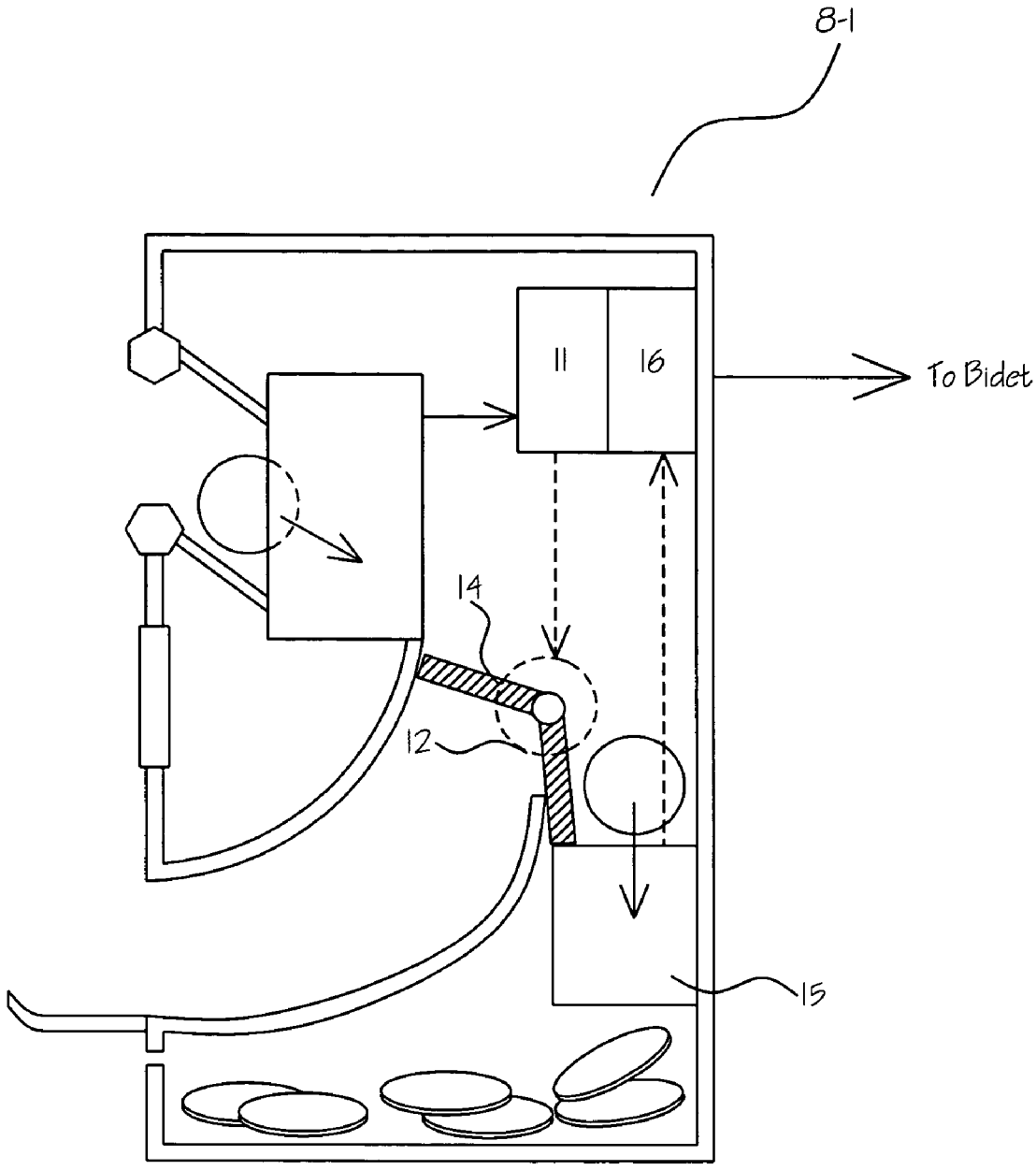
FIG. 4 is a schematic cross sectional view showing the coin handling assembly of the current application when the coin flap is open to coin box.
Figure 5:
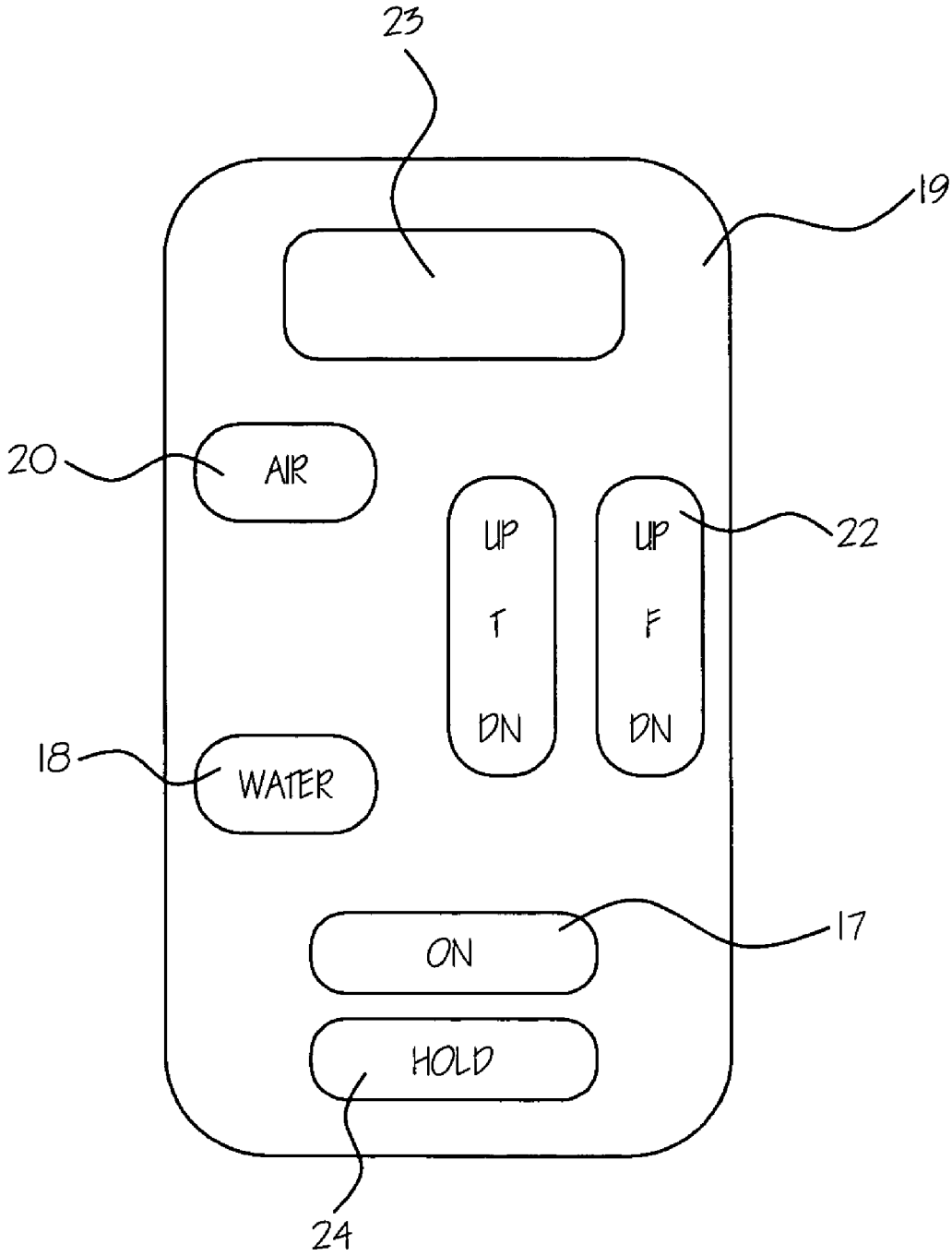
FIG. 5 is an over view of the function keys attached on the control panel of the bidet.

FIG. 2 is a schematic logic diagram of the coin bidet (1) of the current application. The logic diagram is easily understood by referring FIG. 2 to FIG. 4. When a coin (8) is inserted to the coin handling system (8-1) through an inserting slot (9), the coin (8) passes through a coin validator (10). In the coin validator (10), the coin is detected by optical and/or magnetic readers as known in the prior art. The information read by the validator (10) is sent to a microprocessor (11) and compare with information of validated coins. If the coin (8) inserted is not validated, a signal to turn the coin flap (12) to a position of open to return slot (13) is sent to a solenoid valve (14) that is connected to the coin flap (12) as shown in the FIG. 3. The coin flap (12) is has two wings (12-1) connected at the center (12-3) with the solenoid valve (14). The angle (12-4) between the two wings (12-1) is 105 degree to facilitate rolling of the coin (8).

If the coin (8) inserted is proven as a validated by the processor (11), another signal is sent to the solenoid valve (14) to turn the coin flap (12) to a position open to a coin counter (15). The processor (11) sends a signal to turn on the coin counter (15) and to turn on the electronic timer (16) for 30 seconds. The electronic timer (16) is connected to the microprocessor (11) and to the main power switch (17) of the bidet. The coin (8) is dropped into a coin collector box (15-1). If the counter (15) does not sense a coin (8), the micro processor (11) recognizes it as to remain the all the power as it was.

If the counter (15) senses a coin (8), the microprocessor (11) check the time if 30 seconds are lapsed since the last coin is detected. If 30 seconds are not lapsed, the micro processor (11) sends a signal to the timer (16) to add another 30 seconds to the time left. The electric power to the bidet remains "ON".

If 30 seconds are lapsed, the microprocessor sends a signal to supply electric power to the main power switch (17) of the bidet (1) for 30 seconds.

If the user wants to clean with water, the user push the "water" button (18) placed on the control board (19) of the bidet (1). If the user wants to dry with hot air, the user pushes the "air" button (20).

What is claimed is:

1. A user controlling coin operating bidet assembly that is comprised of;

a coin handling system comprising an optical coin validator, a solenoid valve, a coin flap having two wings connected at the center with the solenoid valve and having an angle of 105 degree between the two wings to facilitate rolling of the coin, an optical coin counter, an electronic timer, and microprocessor controlling those parts according to the signals triggered by the coins inserted with a coin collector box; and an electrically operating bidet comprising another solenoid valve for water, a warm air blower connected to the nozzle of the bidet, a switch for selecting water, a switch for selecting air, a switch for controlling the temperature of the air and the water, a switch for controlling the flow rate of the air and the water, a "HOLD" switch to hold the electrical timer and power supply to the bidet, and a "RESET" switch to return the bidet in a continuous mode attached on the control panel of the bidet.

* * * * *